US009064650B2

(12) United States Patent
Keppler et al.

(10) Patent No.: US 9,064,650 B2
(45) Date of Patent: Jun. 23, 2015

(54) ASSEMBLY OF RF-SAFE SWITCH AND DETONATOR SYSTEM IN A NON-RF FREE ENVIRONMENT

(71) Applicant: C&J Spec-Rent Services, Inc., Houston, TX (US)

(72) Inventors: Ed Keppler, Fulshear, TX (US); Steven DeLozier, Missouri City, TX (US)

(73) Assignee: C&J Spec-Rent Services, Inc., Houston, TX (US)

( * ) Notice: Subject to any disclaimer, the term of this patent is extended or adjusted under 35 U.S.C. 154(b) by 0 days.

(21) Appl. No.: 14/302,695

(22) Filed: Jun. 12, 2014

(65) Prior Publication Data

US 2015/0107090 A1 Apr. 23, 2015

Related U.S. Application Data

(60) Provisional application No. 61/834,332, filed on Jun. 12, 2013.

(51) Int. Cl.

| | |
|---|---|
| ***E21B 43/116*** | (2006.01) |
| ***H01H 11/00*** | (2006.01) |
| ***E21B 43/1185*** | (2006.01) |

(52) U.S. Cl.

CPC ..... *H01H 11/00* (2013.01); *E21B 43/1185* (2013.01)

(58) Field of Classification Search

USPC ..... 89/1.151, 1.15; 102/322, 202.5, 202.9, 102/206, 202.1, 202.2, 215; 166/299, 55

See application file for complete search history.

(56) References Cited

U.S. PATENT DOCUMENTS

| | | | | |
|---|---|---|---|---|
| 2,918,001 | A | 12/1959 | Alford | |
| 2,953,971 | A | 9/1960 | Porter | |
| 6,470,803 | B1 * | 10/2002 | Liu et al. | 102/206 |
| 7,762,331 | B2 | 7/2010 | Goodman et al. | |
| 8,091,477 | B2 * | 1/2012 | Brooks et al. | 102/202.7 |
| 8,113,119 | B2 * | 2/2012 | Crawford | 102/313 |
| 2005/0045331 | A1 * | 3/2005 | Lerche et al. | 166/297 |
| 2008/0202325 | A1 | 8/2008 | Bertoja et al. | |
| 2010/0252323 | A1 | 10/2010 | Goodman et al. | |
| 2013/0125772 | A1 * | 5/2013 | Backhus et al. | 102/206 |

OTHER PUBLICATIONS

Hunting Energy Services; ControlFire Perforating Solutions; "The solutions to all of your perforating needs are right here"; Copyright 2012 Hunting Energy Services; www.hunting-intl.com; 2 pages (tri-fold).

* cited by examiner

*Primary Examiner* — J. Woodrow Eldred

(74) *Attorney, Agent, or Firm* — Greenberg Traurig, LLP; Ross Spencer Garsson

(57) ABSTRACT

A method for assembling a radio frequency (RF) safe switch and detonator system in a non-RF free environment. More particularly, the method is for assembling an RF-safe switch and detonator system for an oil well perforating gun at a well-site that is in a non-RF free environment.

25 Claims, 2 Drawing Sheets

ASSEMBLY OF RF-SAFE SWITCH AND DETONATOR SYSTEM IN A NON-RF FREE ENVIRONMENT

CROSS-REFERENCE TO RELATED PATENT APPLICATIONS

This application claims priority to: provisional U.S. Patent Application Ser. No. 61/834,332, filed on Jun. 12, 2013, entitled "Assembly Of RF Safe Switch And Detonator System In A Non-RF Free Environment," which provisional patent application is commonly assigned to the Assignee of the present invention and is hereby incorporated herein by reference in its entirety for all purposes.

TECHNICAL FIELD

The present invention relates to a method for assembling a radio frequency (RF) safe switch and detonator system in a non-RF free environment. More particularly, the invention relates to a method for assembling an RF-safe switch and detonator system for an oil well perforating gun at a well-site that is in a non-RF free environment.

BACKGROUND

The present invention relates to detonating systems used for perforating guns used in the oil field industry. A perforating gun is a device used to perforate oil and gas wells in preparation for well production. Such guns typically contain several shaped explosive charges and are available in a range of sizes and configurations. The diameter of the gun used is typically determined by the presence of wellbore restrictions or limitations imposed by the surface equipment. The perforating gun, fitted with shaped charges or bullets, is lowered to the desired depth in a well and fired to create penetrating holes in casing, cement, and formation. Thus, to perforate is to pierce the casing wall and cement of a wellbore to provide holes through which formation fluids may enter or to provide holes in the casing so that materials may be introduced into the annulus between the casing and the wall of the borehole.

In view of typical levels of electrostatic discharge, RF radiation, stray voltage, and/or accidental or unintended applications of power at the well-site, the switch and detonation system used for a perforating gun needs to be an RF safe system; otherwise, significant steps must be taken to render the well-site an RF free environment. As used herein, "RF safe" means that the switch and detonation system installed on the perforating gun is designed to be substantially immune to typical levels of electrostatic discharge, RF radiation, stray voltage, and/or accidental or unintended applications of power. An "RF safe environment" is an environment in which steps are taken to remove (or turn off) the components that generate electrostatic discharge, RF radiation, stray voltage, and applications of power nearby that would otherwise have interacted with the perforating gun (and its switch and detonation system). Conversely, a "non-RF safe environment" is an environment in which steps have not been taken to prevent typical levels of electrostatic discharge, RF radiation, stray voltage, and/or accidental or unintended applications of power. For example, an environment nearby the well-site at which the perforating gun is to be utilized in which steps have not been taken to prevent typical levels of electrostatic discharge, RF radiation, stray voltage, and/or accidental or unintended applications of power would be a "non-RF-safe environment" well-site.

Typical perforating gun systems use separate components for the pressure bulkhead, detonator, charge holder, detonation cord and wiring to the guns below. Historically, when a perforating gun is built, all the pieces are assembled together (except the detonator) and shipped to the location where the perforating operation is to be conducted. For example, a perforating gun can be made at a first location (e.g., a workshop, manufacturing site, testing facility or non-field location that is not the site at which perforating operations will be conducted) having a plurality of shaped charges having primer ends, a ballistics train including a detonating cord connected to the primer ends of the shaped charges, a detonator receptor that holds a booster and cord in place near a port, and wiring operatively connected between the ends of the gun tube and to the detonator receptor. One end of the detonating cord is also operatively connected to the detonator receptor. The detonator receptor can also include an addressable switch (or other intelligent switch) and a receptacle for receiving the detonator.

The gun tube assembled at the first location is then transported to a second location, which is the site at which the perforating operations will be conducted (e.g., a field location or other deployment site). It is at this second site that the detonator is installed to the perforating gun assembled at the first location. Generally, at that second location, the perforating gun is opened and the detonator is installed. RF-safe detonators (such as exploding foil initiators, exploding wire bridges, and semi-conductor bridges) are utilized to render the switch and detonator systems RF safe. The installation of the RF-safe detonator generally involves the utilization of a safety tube in which the RF-safe detonator is placed into before connection of the detonator to the wiring in the loading tube.

Examples of such RF-safe switch and detonator systems are discussed and described in U.S. Patent Appl. Pub. No. 2008/0202325, published Aug. 28, 2008, to Bertoja et al. By such use of the RF-safe detonator in the switch and detonator systems of the perforating gun, this avoids having to render the second location to be an RF free environment. Stated otherwise, until recently, the prior art taught that the detonator needed to be a RF-safe detonator or the environment needed to be an RF free environment, in order to protect against accidental detonation that could occur due to typical levels of electrostatic discharge, RF radiation, stray voltage, and/or accidental or unintended applications of power. See, e.g., U.S. Pat. No. 7,762,331, issued Jul. 22, 2010, to Goodman et al.

Recently, Hunting Titan has fabricated an RF-safe switch and detonator system that does not require the detonator to be an RF-safe detonator. This is done by combining (a) an addressable switch (such as Hunting Titan's ControlFire switch); (b) a standard detonator (such as an Austin Powder resistorized detonator having a minimum resistance of 50Ω); and a shunt switch. This combination system (which Hunting Titan refers to as its RF-Safe ControlFire-System) is assembled together with the shunt switch being set in the shorted position. The perforating gun is prepared at the first location independent of the RF-Safe ControlFire-System (and its three components). Since the addressable switch is part of the RF-Safe ControlFire-System, the addressable switch is not included within the perforating gun during this assembly at the first location.

After transport to the second location, the RF-Safe ControlFire System is then installed onto the perforating gun. Again, this requires connecting the addressable switch to the perforating gun at the second location. The shunt switch (which is part of the RF-Safe ControlFire System) is then turned to the non-shorted/armed position so that that the detonator system can then be installed onto the detonation cord (at which time the perforating gun is ready to be sent downhole for use).

While the RF-Safe ControlFire System utilizes a more reliable and more economical resistorized detonator (as compared with RF-safe detonators), this system has a significant drawback because this system requires that the addressable switch be installed at the second location, rather than the first. Because of this, the perforating gun is not testable at the first location (e.g., workshop, manufacturing site, testing facility). U.S. Pat. No. 2,953,971, issued Sep. 27, 1960, to Porter, shows the importance of being able to test at a location remote from the wellsite to enhance the margin of safety.

Testing at the first location is desirable because efficiencies and reliability are gained because, for example, any problems with the perforating gun can be identified and repair (or components replaced) before bringing the perforating gun to the well-site. Furthermore, such testing at the first location significantly reduces that there will be problems with the perforating gun at the second location. Indeed, if problems are identified at the second location, it may require returning the perforating gun back to the first location for repair or replacement or, alternatively, will require attempts to repair the perforating gun on-site with only a subset of equipment and parts that are back at the first location. Hence, it is safer and more economical to be able to test the perforating gun at the first location, something that cannot be done when using the RF-Safe ControlFire System.

Accordingly, there is a need for a method to create a RF-safe switch and detonator system that can utilize the more efficient and reliable resistorized detonators (rather than RF-safe detonators), while still affording the perforating gun to be assembled and tested at the first location before safely transporting the perforating gun to the well-site for use.

SUMMARY OF THE INVENTION

The embodiments of the subject invention are described a method for assembling a radio frequency (RF) safe switch and detonator system in a non-RF free environment. More particularly, the embodiments describe a method for assembling an RF-safe switch and detonator system for an oil well perforating gun at a well-site that is in a non-RF free environment.

In general, in one aspect, the invention features a method that includes selecting an intelligent switch system and a shunted detonator. The shunted detonator is not an RF-safe detonator and includes a shunt and a detonator having detonator leads connected to the shunt. The method further includes assembling a perforating gun system without the shunted detonator at a first location. The first location is not at a well-site location at which the perforating gun system will be used for perforating. The step of assembling the perforating gun at the first location includes installing the intelligent switch system and wiring into a loading tube, and includes installing shaped charges and detonating cord into the loading tube. The method further includes testing the assembled perforating gun system. The method further includes transporting the assembled perforating gun system to the well-site location after the step of testing the assembled perforating gun system. The method further includes transporting the shunted detonator to the well-site location. The method further includes, at the well-site location, removing the shunt from the detonator by disconnecting each of the detonator leads from the shunt. The method further includes trimming each of the detonator leads so that each trimmed detonator leads is at most eight inches in length. The method further includes connecting the trimmed detonator leads to the intelligent switch system of the assembled perforating gun system at the well-site location. The step of connecting is performed at the well-site location that is a non-RF safe environment. The combination of the detonator, the trimmed detonator leads, and the intelligent switch system is an RF-safe switch and detonator system.

Implementations of the invention can include one or more of the following features:

The intelligent switch system can be an addressable switch system.

The addressable switch system can include a processor that controls the addressable switch system.

The addressable switch system can be capable of receiving and sending initiation signals and confirmation signals.

The shunted detonator can be a resistorized-type detonator.

The resistorized-type detonator can have a minimum resistance of 50Ω.

The step of testing the assembled perforating gun system can be performed at the first location.

The step of testing the assembled perforating gun system can be performed at a second location that is not the first location and is not the well-site location.

The step of trimming the detonator leads can be performed at the well-site location.

The step of trimming the detonator leads can be performed at a location other than the well-site location.

The step of trimming the detonator leads at a location other than the well-site location can include trimming each of the detonator leads so that each of the detonator leads is at most eight inches in length, and can further include connecting the shunt to the trimmed detonator leads.

The step of trimming the detonator leads at a location other than the well-site location can further include disconnecting the shunt from the detonator leads before trimming each of the detonator leads.

The step of trimming the detonator leads at a location other than the well-site location can further include disconnecting a different shunt from the detonator leads before trimming each of the detonator leads.

The step of trimming the detonator leads can include trimming each of the detonator leads simultaneously.

The step of trimming the detonator leads can include trimming the detonator leads while the detonator leads are still connected to the shunt.

The step of trimming the detonator leads can remove the shunt from the detonator by disconnecting each of the detonator leads from the shunt.

The method can further include placing the detonator in a safety tube before and during the step of removing the shunt from the detonator by disconnecting each of the detonator leads from the shunt. The method can further include removing the detonator from the safety tube after combining the detonator, the trimmed detonator leads, and the intelligent switch system to form the RF-safe switch and detonator system.

The method can further include completely assembling the perforating gun system. The complete assembled perforating gun system can include the assembled perforating gun system and the RF-safe switch and detonator system. The method can further include running the complete assembled perforated gun system downhole in a well at the well-site location to a predetermined depth. The method can further include detonating the detonator using the RF-safe switch and detonator system while maintaining the complete assembled perforating gun system at the predetermined depth.

The step of assembling the perforating gun at the first location further includes installing one or more mechanical switch systems that detonate from the detonation of the RF-safe switch detonator system.

The method can further include selecting one or more additional intelligent switch systems and a corresponding number of one or more additional shunted detonators. Each of the one or more additional shunted detonators is not an RF-safe detonator and includes a unique shunt and a unique detonator having unique detonator leads connected to the unique shunt. The method can further include the step of assembling the perforating gun at the first location includes installing each of the one or more additional intelligent switch systems and wiring into a corresponding number of one or more additional loading tubes, and further includes installing additional shaped charges and additional detonating cord into the one or more loading tubes. The method can further include transporting the one or more additional shunted detonators to the well-site location after the step of testing the assembled perforating gun system. The method can further include, at the well-site location, for each of the one or more additional shunted detonators, removing the unique shunt from the unique detonator by disconnecting each of the unique detonator leads from the unique shunt. The method can further include, for each of the one or more additional shunted detonators, trimming each of the unique additional detonator leads so that each unique additional trimmed detonator leads is at most eight inches in length. The method can further include, for each of the one or more additional shunted detonators, connecting the unique additional trimmed detonator leads to the corresponding additional intelligent switch system of the assembled perforating gun system at the well-site location. The step of connecting can be performed at the well-site location that is a non-RF safe environment. The combination of the additional unique detonator, the unique additional trimmed detonator leads, and the corresponding additional intelligent switch system is a unique RF-safe switch and detonator system.

The intelligent switch system can be an addressable switch system. The one or more additional intelligent switch systems can be one or more additional addressable switch systems.

The RF-safe switch and detonator system and the one or more additional RF-safe switch and detonator systems are individually controllable.

The complete assembled perforating gun system can include the assembled perforating gun system, the RF-safe switch and detonator system, and the one or more addition RF-safe switch and detonator systems. The method can further include detonating each of the unique detonators using the corresponding additional RF-safe switch and detonator system while maintaining the complete assembled perforated gun system at the predetermined depth.

The complete assembled perforating gun system can include the assembled perforating gun system, the RF-safe switch and detonator system, and the one or more addition RF switch and detonator systems. The method can further include running the complete assembled perforating gun system downhole in the well to a second predetermined depth. The method can further include detonating at least one of the one or more unique detonators using the corresponding additional RF-safe switch and detonator systems while maintaining the complete assembled perforated gun system at the second predetermined depth.

The assembled perforating gun system and the shunted detonator can be separately transported to the well-site location.

DETAILED DESCRIPTION

The present invention relates to a method for assembling at an RF-safe switch and detonator system for an oil well perforating gun at a well-site that is in a non-RF free environment.

Figure 1:
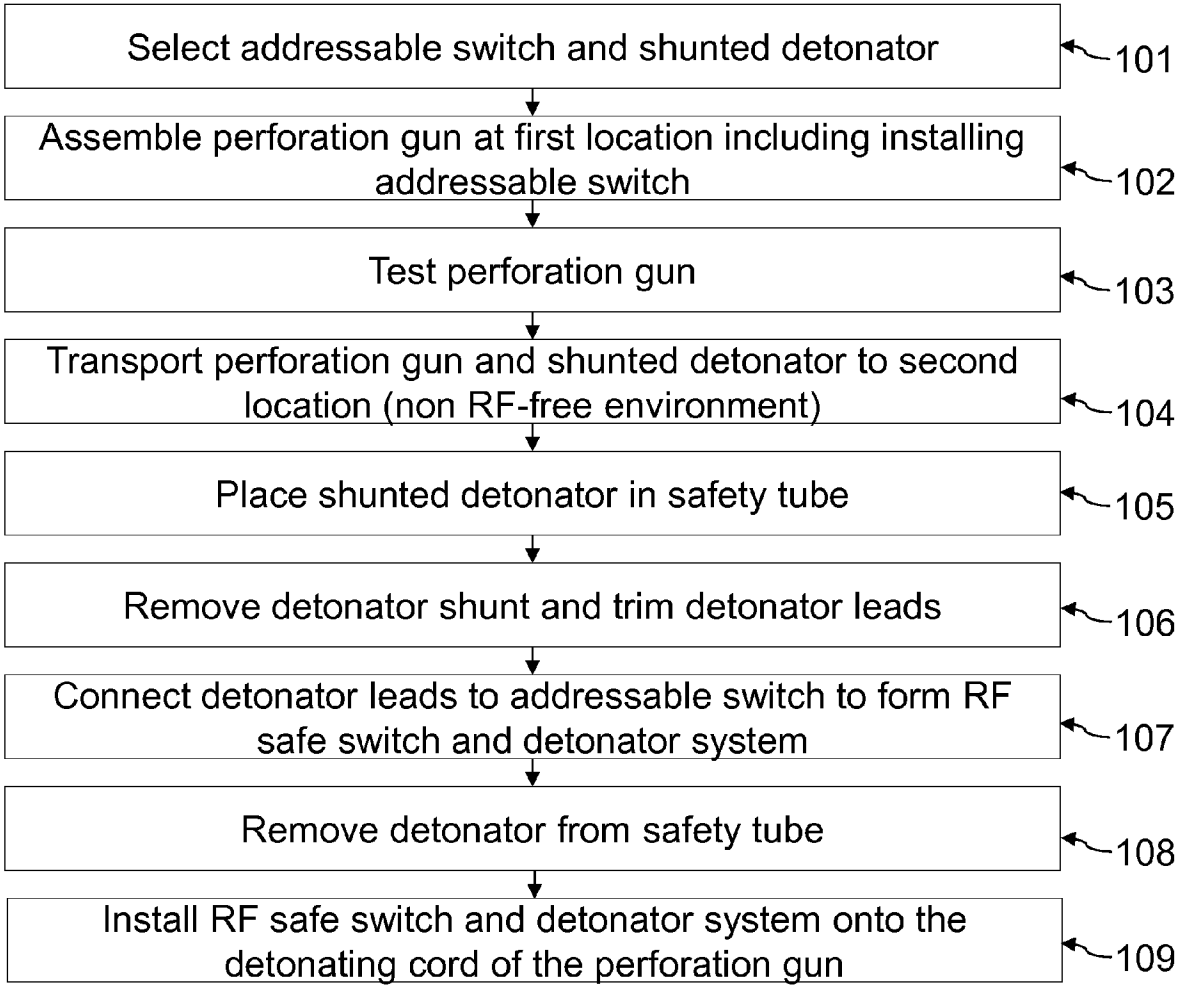
FIG. 1 is a flowchart that illustrates an embodiment of the present invention of a method for making a perforating gun having an RF-safe switch and detonating system assembled in a non-RF safe environment.

Referring to FIG. 1, FIG. 1 illustrates an embodiment of the present invention. In step 101, an addressable switch and a shunted detonator are selected. The addressable switch can be, for example, a ControlFire switch (Titan Specialties, Ltd, Pampa, Tex.). Alternatively, other types of intelligent switches can be utilized. The shunted detonator can be a resistorized-type detonator having a minimum resistance of 50Ω, such as from Austin Powder (Cleveland, Ohio). For example, an Austin Powder Oilstar detonator models A-85, A-140 (all versions A-140, A1405, A-140 F&Block) and A-161 can be used. Other resistorized detonators include Owen Oil Tools (Godley, Tex.) models DET-3050-1255, DET-3050-084, and DET-3050-006 and DYNAenergetics (Austin, Tex.) models 0015FD, 0015FDS, 0026FD, and 0026FDS.

The detonators that are received from the manufacturers are shunted. The detonators are kept shunted and are set aside for use until later in the method set forth in FIG. 1.

In step 102, the perforation gun is assembled at the first location (such as the service shop). During this assembly, the addressable switch is installed.

In step 103, the assembled perforating gun is tested. This can be done, for example, using surface checking hardware known in the art that is at the first location. To the extent necessary, the assembled perforating gun can be further worked upon so that it passes all tests and is deemed fit to be utilized at the second location.

In step 104, the assembled perforating gun is transported to the second location (such as the well-site). The resistorized detonator (not assembled with the perforating gun) is also transported to the second location. Since the resistorized detonator is still shunted (as provided by manufacturer), such transportation can be performed safely.

In step 105, the resistorized detonator is placed inside a safety tube. Such safety tubes include Owen Oil Tools detonator safety shield model DET-2000-000 or Titan Specialties, Ltd. Safety Tubes models 9000-830-000 and 9000-840-000.

In step 106, the shunt is removed from the wires while the detonator in the safety tube. The detonator leads of the detonators are trimmed so that the leads are 8 inches (20 cm) or shorter. Generally, the trimming of the leads will encompass trimming the leads simultaneously while still connected to the shunt (which results in the removal of the shunt from the detonator). There is a concern that that removal of the shunt while the leads remain un-cut creates the potential for the wires to act as an antenna for receiving electrostatic discharge, RF radiation, stray voltage, and/or accidental or unintended applications of power.

Figure 2:
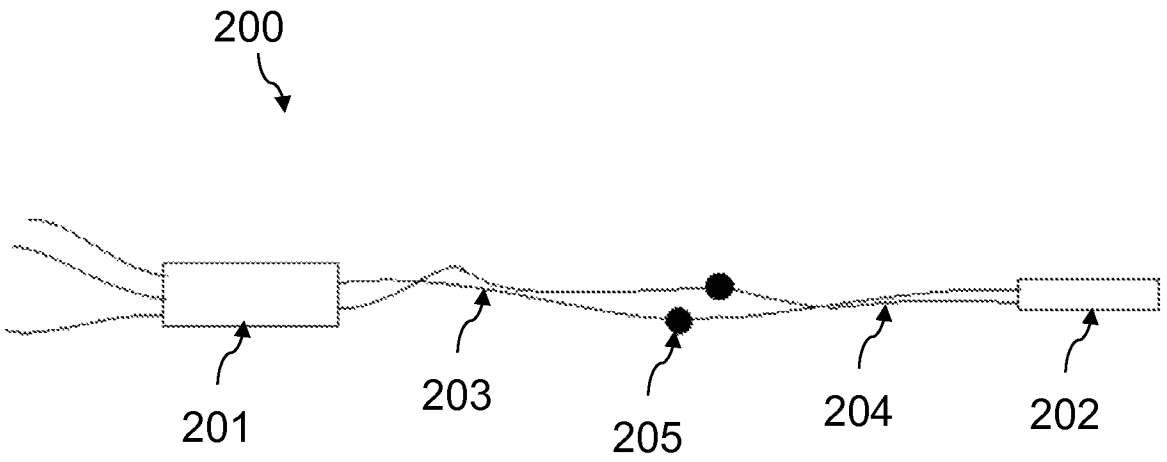
FIG. 2 illustrates the RF-safe switch and detonating system of the perforating gun made using the process shown in FIG. 1.

In step 107, the detonator leads are then connected to addressable switch to form an RF-safe switch and detonator system. An illustration of an RF-safe switch and detonator system 200 is shown in FIG. 2. The RF-safe switch and detonator system 200 includes the addressable switch 201 (with flexible wires 203) and the resistorized detonator 202 (with leads 204 that are less than 8 inches in length) that are connected at connections 205.

It has been found that, by trimming the leads 204 such that they are maintain below this 8 inch length, these leads do not (and cannot) make an effective antenna for receiving electrostatic discharge, RF radiation, stray voltage, and/or accidental or unintended applications of power in the final switch and detonator system. Because of this, the process reflected in FIG. 1, including step 107 can (and are) performed in a non-RF free environment.

In step 108, the detonator is removed from the safety tube.

It should be noted that this arrangement (made in Step 108) is electrically the same as the RF-Safe ControlFire System after it is connected to the perforating gun and the shunt switch is switched to the non-shorted position. Hence, this present invention is a process that results in an RF-safe switch and detonator system that is assembled in a non-RF safe environment without the need for using a shunt switch and that allows the addressable switch to be connected to the perforating gun while still at the first location. Thus, the present invention is a process that affords, for the first time, an assembly process that results in a RF-safe switch and detonator system using a more reliable and economical resistorized detonator that can be made in a non-RF safe environment and also allows the perforating gun to be assembled at the service shop (or other first location) where it can be properly tested to insure that it has been assembled properly before transporting to the well-site.

In step 109, the RF-safe switch and detonator system is installed onto the detonating cord of the perforation gun. The perforating gun can then be run downhole for perforating the wellbore.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, other embodiments are within the scope of the following claims. The scope of protection is not limited by the description set out above, but is only limited by the claims which follow, that scope including all equivalents of the subject matter of the claims.

What is claimed is:

1. A method comprising:

(a) selecting an intelligent switch system and a shunted detonator, wherein the shunted detonator is not an RF-safe detonator and comprises a shunt and a detonator having detonator leads connected to the shunt;

(b) assembling a perforating gun system without the shunted detonator at a first location, wherein the first location is not at a well-site location at which the perforating gun system will be used for perforating, and wherein the step of assembling the perforating gun at the first location comprises (i) installing the intelligent switch system and wiring into a loading tube, and (ii) installing shaped charges and detonating cord into the loading tube;

(c) testing the assembled perforating gun system;

(d) transporting the assembled perforating gun system to the well-site location after the step of testing the assembled perforating gun system;

(e) transporting the shunted detonator to the well-site location;

(f) at the well-site location, removing the shunt from the detonator by disconnecting each of the detonator leads from the shunt;

(g) trimming each of the detonator leads so that each trimmed detonator leads is at most eight inches in length; and (h) connecting the trimmed detonator leads to the intelligent switch system of the assembled perforating gun system at the well-site location, wherein (i) the step of connecting is performed at the well-site location that is a non-RF safe environment, and, (ii) the combination of the detonator, the trimmed detonator leads, and the intelligent switch system is an RF-safe switch and detonator system.

2. The method of claim 1, wherein the intelligent switch system is an addressable switch system.

3. The method of claim 2, wherein the addressable switch system comprises a processor that controls the addressable switch system.

4. The method of claim 2, wherein the addressable switch system is capable of receiving and sending initiation signals and confirmation signals.

5. The method of claim 1, wherein the shunted detonator is a resistorized-type detonator.

6. The method of claim 5, wherein the resistorized-type detonator has a minimum resistance of 50Ω.

7. The method of claim 1, wherein the step of testing the assembled perforating gun system is performed at the first location.

8. The method of claim 1, wherein the step of testing the assembled perforating gun system is performed at a second location that is not the first location and is not the well-site location.

9. The method of claim 1, wherein the step of trimming the detonator leads is performed at the well-site location.

10. The method of claim 1, wherein the step of trimming the detonator leads is performed at a location other than the well-site location.

11. The method of claim 10, wherein the step of trimming the detonator leads at a location other than the well-site location comprises (a) trimming each of the detonator leads so that each of the detonator leads is at most eight inches in length, and (b) connecting the shunt to the trimmed detonator leads.

12. The method of claim 11, wherein the step of trimming the detonator leads at a location other than the well-site location further comprises disconnecting the shunt from the detonator leads before trimming each of the detonator leads.

13. The method of claim 11, wherein the step of trimming the detonator leads at a location other than the well-site location further comprises disconnecting a different shunt from the detonator leads before trimming each of the detonator leads.

14. The method of claim 1, wherein the step of trimming the detonator leads comprises trimming each of the detonator leads simultaneously.

15. The method of claim 14, wherein the step of trimming the detonator leads comprises trimming the detonator leads while the detonator leads are still connected to the shunt.

16. The method of claim 14, wherein the step of trimming the detonator leads removes the shunt from the detonator by disconnecting each of the detonator leads from the shunt.

17. The method of claim 1 further comprising (a) placing the detonator in a safety tube before and during the step of removing the shunt from the detonator by disconnecting each of the detonator leads from the shunt; and (b) removing the detonator from the safety tube after combining the detonator, the trimmed detonator leads, and the intelligent switch system to form the RF-safe switch and detonator system.

18. The method of claim 1 further comprising (a) completely assembling the perforating gun system, wherein the complete assembled perforating gun system comprises the assembled perforating gun system and the RF-safe switch and detonator system;

(b) running the complete assembled perforated gun system downhole in a well at the well-site location to a predetermined depth; and (c) detonating the detonator using the RF-safe switch and detonator system while maintaining the complete assembled perforated gun system at the predetermined depth.

19. The method of claim 1, wherein the step of assembling the perforating gun at the first location further comprises installing one or more mechanical switch systems that detonate from the detonation of the RF-safe switch detonator system.

20. The method of claim 1 further comprising:

(a) selecting one or more additional intelligent switch systems and a corresponding number of one or more additional shunted detonators, where each of the one or more additional shunted detonators is not an RF-safe detonator and comprises a unique shunt and a unique detonator having unique detonator leads connected to the unique shunt;

(b) the step of assembling the perforating gun at the first location further comprises (i) installing each of the one or more additional intelligent switch systems and wiring into a corresponding number of one or more additional loading tubes, and (ii) installing additional shaped charges and additional detonating cord into the one or more loading tubes;

(c) transporting the one or more additional shunted detonators to the well-site location after the step of testing the assembled perforating gun system;

(d) at the well-site location, for each of the one or more additional shunted detonators, removing the unique shunt from the unique detonator by disconnecting each of the unique detonator leads from the unique shunt;

(e) for each of the one or more additional shunted detonators, trimming each of the unique additional detonator leads so that each unique additional trimmed detonator leads is at most eight inches in length;

(f) for each of the one or more additional shunted detonators, connecting the unique additional trimmed detonator leads to the corresponding additional intelligent switch system of the assembled perforating gun system at the well-site location, wherein (i) the step of connecting is performed at the well-site location that is a non-RF safe environment, and, (ii) the combination of the additional unique detonator, the unique additional trimmed detonator leads, and the corresponding additional intelligent switch system is a unique RF-safe switch and detonator system.

21. The method of claim 20, wherein (a) the intelligent switch system is an addressable switch system; and (b) the one or more additional intelligent switch systems are one or more additional addressable switch systems.

22. The method of claim 20, wherein the RF-safe switch and detonator system and the one or more additional RF-safe switch and detonator systems are individually controllable.

23. The method of claim 22, wherein (a) the complete assembled perforating gun system comprises the assembled perforating gun system, the RF-safe switch and detonator system, and the one or more addition RF-safe switch and detonator systems, and (b) the method further comprises detonating each of the unique detonators using the corresponding additional RF-safe switch and detonator system while maintaining the complete assembled perforated gun system at the predetermined depth.

24. The method of claim 22, wherein (a) the complete assembled perforating gun system comprises the assembled perforating gun system, the RF-safe switch and detonator system, and the one or more addition RF-safe switch and detonator systems, (b) the method further comprises running the complete assembled perforating gun system downhole in the well to a second predetermined depth, and (c) the method further comprises detonating at least one of the one or more unique detonators using the corresponding additional RF-safe switch and detonator systems while maintaining the complete assembled perforated gun system at the second predetermined depth.

25. The method of claim 1, wherein the assembled perforating gun system and the shunted detonator are separately transported to the well-site location.

* * * * *